US006848587B1

(12) United States Patent
Chao

(10) Patent No.: US 6,848,587 B1
(45) Date of Patent: Feb. 1, 2005

(54) LOCATING STRUCTURE OF A RACK USED FOR HOLDING PISTOL-TYPE NOZZLES

(76) Inventor: Hui-Chen Chao, 75, Liau Tsuoh Lane, Liau Tsuoh Li, Lu-Kang Chen, Chang-Hua Hsien (TW)

( * ) Notice: Subject to any disclaimer, the term of this patent is extended or adjusted under 35 U.S.C. 154(b) by 166 days.

(21) Appl. No.: 10/270,397

(22) Filed: Oct. 11, 2002

(51) Int. Cl.[7] ..... A47F 7/00
(52) U.S. Cl. ..... 211/70.6; 211/60.1
(58) Field of Search ..... 211/70.6, 60.1, 211/59.1, 70

(56) References Cited

U.S. PATENT DOCUMENTS 5,080,240 A * 1/1992 Williams ..... 211/70.6
D454,013 S * 3/2002 Wang ..... D6/469
6,398,045 B1 * 6/2002 Chao ..... 211/70.6
6,471,076 B1 * 10/2002 Chen ..... 211/70.6
6,508,369 B2 * 1/2003 Wang ..... 211/60.1

* cited by examiner

*Primary Examiner*—Robert W. Gibson, Jr.
(74) *Attorney, Agent, or Firm*—Charles E. Baxley

(57) ABSTRACT

A rack includes a top frame and a bottom frame. The top frame is provided with a plurality of through slots for accommodating the barrels of the pistol-type nozzles. The bottom frame is provided with a plurality of locating slots and locating seats. The locating slots and the locating seats are arranged alternately in rows corresponding in location to the through slots of the top frame. The locating slots are provided with a locating projection, which is fitted into the hose connection hole of the hand grip of the pistol-type nozzles. The locating seats are provided with a recessed portion for resting the control knob of the pistol-type nozzles.

1 Claim, 3 Drawing Sheets

LOCATING STRUCTURE OF A RACK USED FOR HOLDING PISTOL-TYPE NOZZLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rack used for holding a plurality of pistol-type nozzles, and more particularly to a structure of the rack by which the nozzles are securely located in place on the rack.

BACKGROUND OF THE INVENTION

The conventional pistol-type nozzle comprises a nozzle head, a hand grip, a control knob disposed on the hand grip, and a barrel connecting the nozzle head with the hand grip. The control knob is used for regulating the flow of water, which is emitted by the nozzle head for watering a lawn, golf course or for washing an object. The conventional rack for holding such conventional pistol-type nozzles as described above is rather simple and primitive in design because it cannot hold the pistol-type nozzles in an orderly manner, and because it is devoid of means to securely hold each of the pistol-type nozzles.

BRIEF SUMMARY OF THE INVENTION

The primary objective of the present invention is to provide a rack with a locating structure for holding securely each of the pistol-type nozzles. The locating structure comprises a plurality of locating seats and locating slots. The locating seats are provided with a recessed portion for locating the control knob of the pistol-type nozzle. The locating slots are provided with a projection for locating the hand grip of the pistol-type nozzle.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
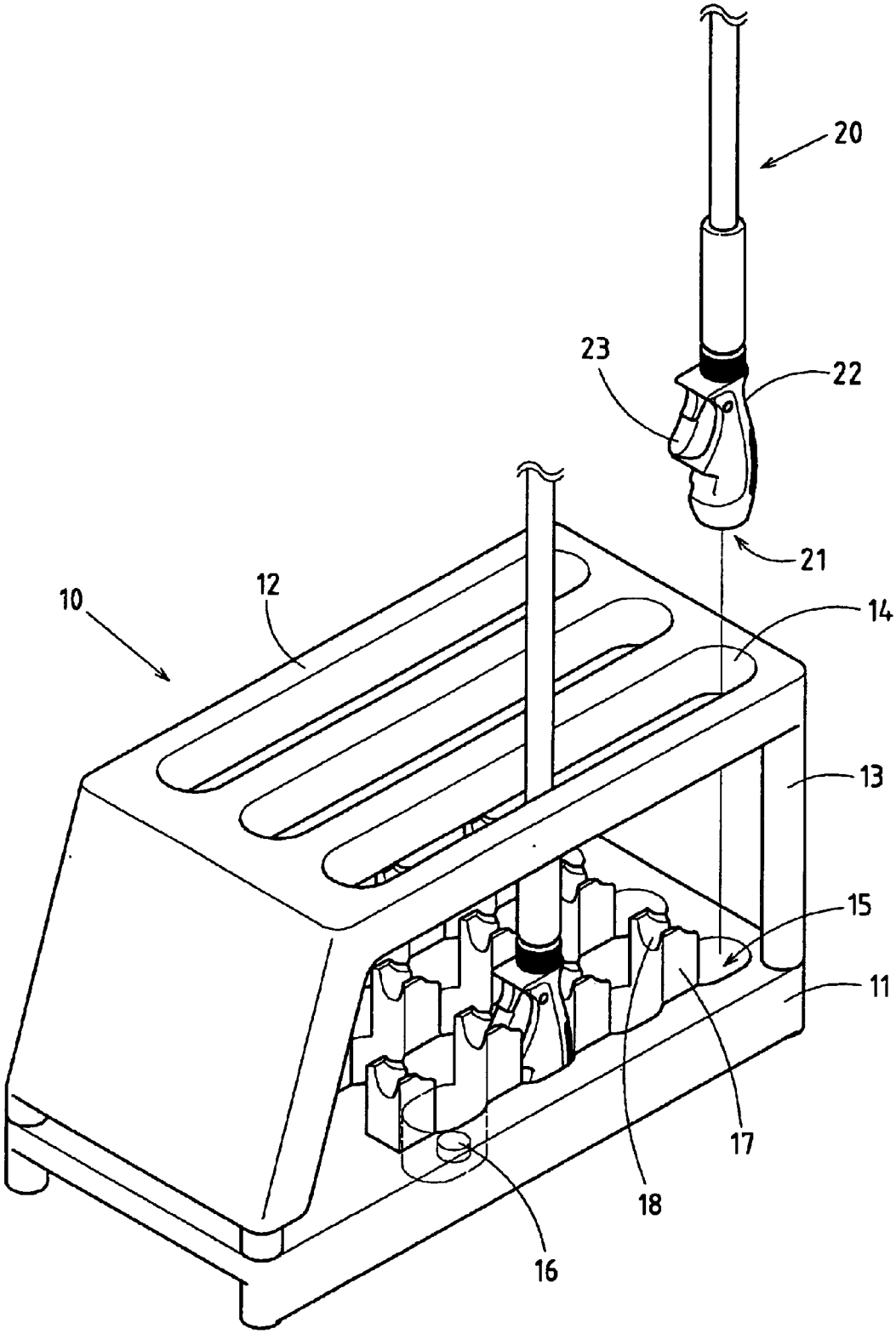
FIG. 1 shows a perspective view of the preferred embodiment of the present invention.

As shown in FIGS. 1-4, a rack 10 embodied in the present invention is designed to hold securely a plurality of pistol-type nozzles 20, each comprising a nozzle head, a barrel, a hand grip 22, and a control knob 23 disposed on the head grip 22. In light of the nozzle head and the barrel being irrelevant, they are not labeled in FIGS. 1 and 2.

The rack 10 comprises a bottom frame 11, a top frame 12, and a plurality of support rods 13 disposed between the bottom frame 11 and the top frame 12, thereby forming an empty space between the bottom frame 11 and the top frame 12, which is provided with a plurality of through slots 14 parallel to one another. The bottom frame 11 is provided in the upper side with a plurality of locating slots 15 and locating seats 17 alternating with the locating slots 15 in a row. In another words, there are a plurality of rows of locating slots 15 and the locating seats 17, with the rows being corresponding in location and number to the through slots 14 of the top frame 12.

Figure 2:
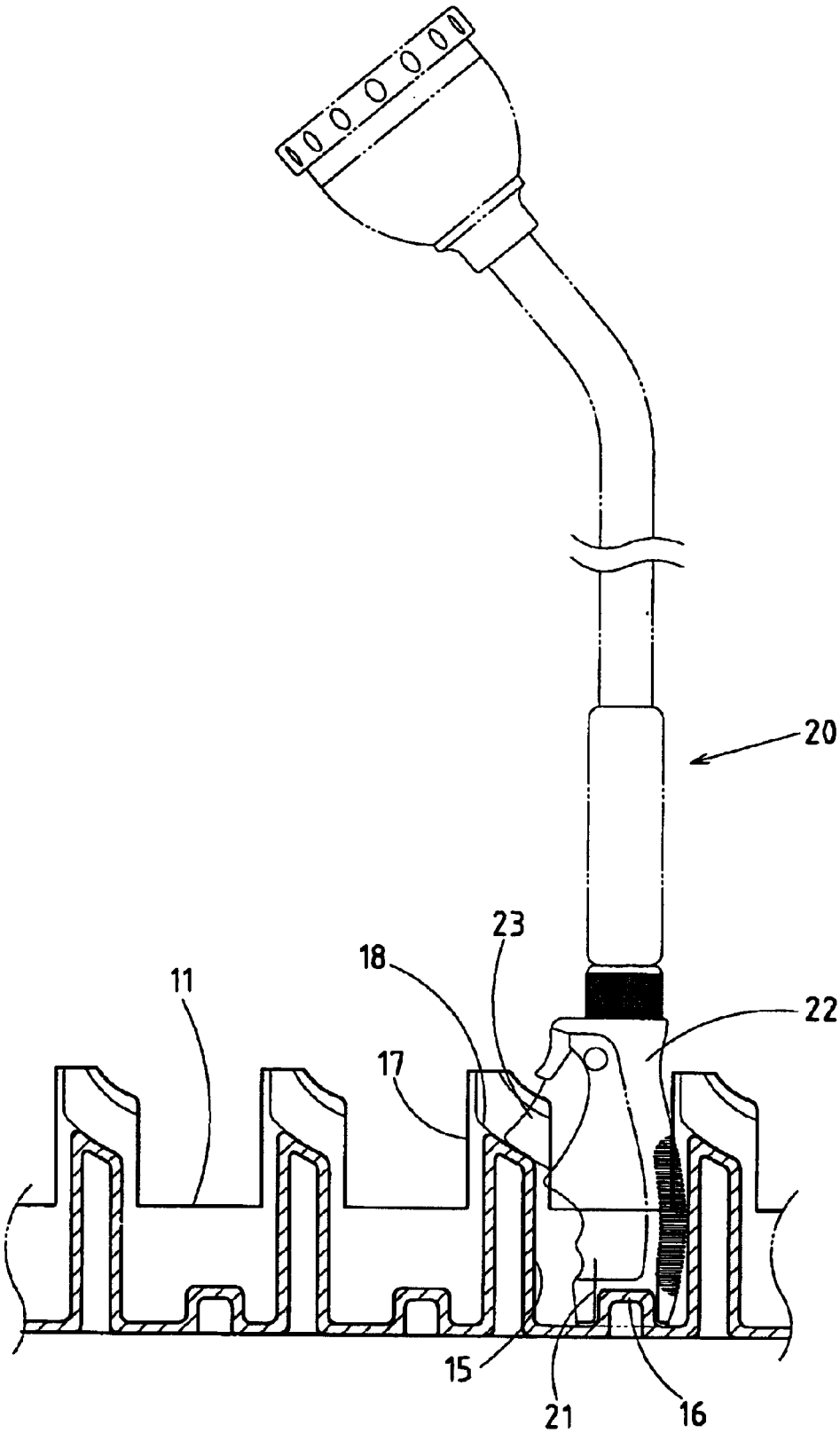
FIG. 2 shows a partial sectional view of the preferred embodiment of the present invention at work.
Figure 3:
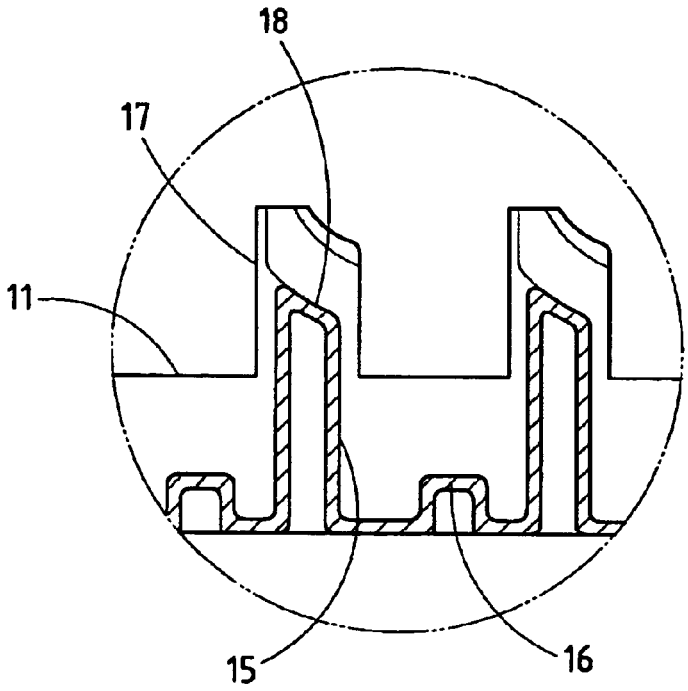
FIG. 3 shows an enlarged sectional view of the locating structure of the preferred embodiment of the present invention.
Figure 4:
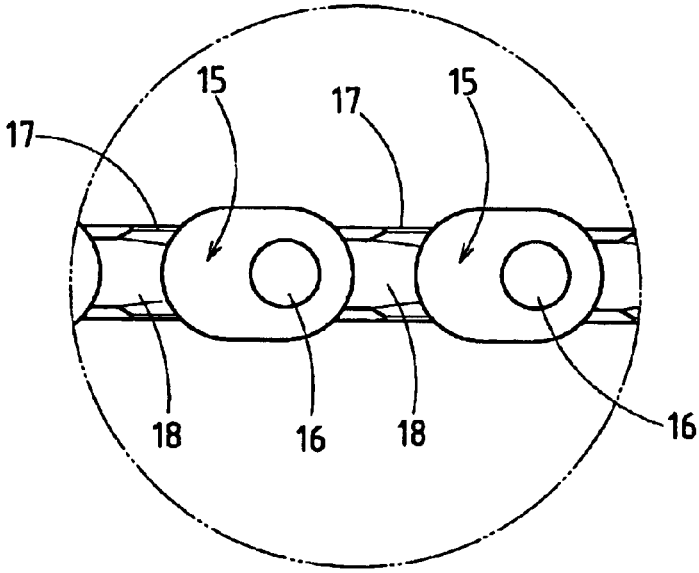
FIG. 4 shows a top plan view of the locating structure of the preferred embodiment of the present invention.

The present invention is characterized by the locating slots 15 which are provided in the bottom wall with an upright projection 16. The projection 16 is dimensioned to fit into a hose connection hole 21 of the bottom end of the hand grip 22 of the pistol-type nozzle 20, as shown in FIG. 2. The present invention is further characterized by the locating seats 17 which are provided with a recessed portion 18 for resting the control knob 23 of the pistol-type nozzle 20, as shown in FIG. 2. Each of the pistol-type nozzles 20 is held securely in place in the rack 10 of the present invention such that the barrel is put through the through slot 14 of the top frame 12, and that the control knob 23 is securely rested in the recessed portion 18 of the locating seat 17 of the bottom frame 11, and that the bottom end of the hand grip 22 is located in the locating slot 15 of the bottom frame 1, and that the projection 16 of the locating slot 15 is fitted into the hose connection hole 21 of the hand grip 22.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A rack apparatus comprising:

a plurality of pistol-type nozzles each comprising:
- a barrel;
- a hand grip affixed to the end of said barrel, said handgrip having a hose connection hole formed at an end thereof opposite said barrel; and
- a control knob mounted on said hand grip and extending outwardly therefrom;

a top frame having a plurality of continuous slots formed therein and extending parallel to each other, each of said plurality of continuous slots suitable for receiving more than one barrel of said plurality of pistol-type nozzles therein; and a bottom frame having an upper surface and a lower surface, said bottom frame connected to said top frame by a plurality of support rods, said bottom frame having a plurality of locating slots and a plurality of locating seats arranged alternately in rows positioned directly below said plurality of continuous slots of said top frame respectively, each of said plurality of locating slots formed so as to open at said upper surface of said bottom frame and to be closed at said lower surface of said bottom frame, each of said plurality of locating seats having an upper end extending above said upper surface of said bottom frame, said upper end having a recessed portion formed therein, said control knob resting within said recessed portion of the locating seat, the hand grip having said end thereof received within one of said plurality of locating slots, each of said plurality of locating slots having locating projections extending upwardly from said lower surface thereof, said hose connection hole residing over said locating projection.

* * * * *